US006039093A

United States Patent [19]

Mrotzek et al.

[11] Patent Number: 6,039,093

[45] Date of Patent: Mar. 21, 2000

[54] ADAPTER FOR EXTRACTING A LIQUID FROM A CONTAINER CLOSED WITH A STOPPER

[75] Inventors: Werner Mrotzek; Bernd Gräf; Ingoberth Schönke, all of Berlin, Germany

[73] Assignee: Schering Aktiengesellschaft, Berlin, Germany

[21] Appl. No.: 09/051,791

[22] PCT Filed: Oct. 18, 1996

[86] PCT No.: PCT/DE96/02027

§ 371 Date: Aug. 27, 1998

§ 102(e) Date: Aug. 27, 1998

[87] PCT Pub. No.: WO97/15267

PCT Pub. Date: May 1, 1997

[30] Foreign Application Priority Data

Oct. 20, 1995 [DE] Germany ..... 195 40 476

[51] Int. Cl.[7] ..... B65B 1/04

[52] U.S. Cl. ..... 141/386; 141/329; 604/416

[58] Field of Search ..... 141/18, 329, 330, 141/382, 386; 604/240, 243, 416

[56] References Cited

U.S. PATENT DOCUMENTS

| | | | |
|---|---|---|---|
| 4,927,423 | 5/1990 | Malmborg . | |
| 5,454,409 | 10/1995 | McAffer et al. . | |
| 5,464,123 | 11/1995 | Scarrow . | |
| 5,526,853 | 6/1996 | McPhee et al. | 141/386 |
| 5,641,010 | 6/1997 | Maier | 141/386 |

FOREIGN PATENT DOCUMENTS

| | | |
|---|---|---|
| 499 481 | 8/1992 | European Pat. Off. . |
| 88 01881 | 3/1988 | WIPO . |
| 93 24095 | 12/1993 | WIPO . |
| 95 07066 | 3/1995 | WIPO . |

*Primary Examiner*—Steven O. Douglas
*Attorney, Agent, or Firm*—Millen, White, Zelano & Branigan

[57] ABSTRACT

An adaptor for drawing a liquid from a container that is sealed with a plug or for filling the container. The container being sealed with a plug that is attached by a flange cap. At least one mandrel on the front end of the adaptor for penetrating the plug, a connecting part with an inner cone at the rear end for hooking up medical devices, and a flat gripping element in the intermediate area for facilitating the adaptation process. A funnel that is open toward the rear end is arranged on the connecting part of the adaptor. In addition, an elastic centering and gripping part is arranged toward the front end of the adaptor on the gripping element. The inner contour of the centering and gripping part approximately corresponds, at least in terms of area, to the outer contour of the flange cap that attaches the plug to the injection container. The inner contour also has locking elements that engage behind the flange cap at least in sections. With this adaptor, a liquid can, via a standard syringe, be both drawn from and introduced into a container that is sealed with a plug. Moreover, the filling process can be carried out quickly and reliably, without any danger of injury and with little effort.

9 Claims, 2 Drawing Sheets

ADAPTER FOR EXTRACTING A LIQUID FROM A CONTAINER CLOSED WITH A STOPPER

This invention relates to an adapter for drawing a liquid from a container that is sealed with a plug or for filling this container, which is sealed using a plug that is attached by a flange cap, with at least one partially hollow mandrel that is equipped with at least one nozzle on the front end to penetrate the plug, a connecting part with an inner cone on the rear end for hooking up medical devices, and a flat gripping element in the intermediate area for facilitating the adaptation process.

Such adapters or drawing cannulae, cf. EP 0 499 481 A1 and WO 93/24095, are used in the medical field to make it possible to connect commercially available infusion instruments, i.a., to infusion flasks. To do this, the adapters generally have a lockable cone connection according to DIN 13 090, Part 2. The connecting of the infusion instruments to the infusion flasks is done by skilled personnel, who do not have any problem in penetrating the sealing plug of the infusion flasks with the adapter or in coupling the instruments to the adapter. For an individual who is not proficient, however, it is very difficult to couple the infusion flask to the adapter. In the case of an adapter that engages behind the flange cap of the infusion flask with the aid of locking elements, the mandrel must penetrate the rubber plug at the instant when the locking elements also come to rest on the edge of the flange cap so that these elements can be pressed outward. It is precisely in the initial phase of the penetration, i.e., when a great deal of force is required, that the opened-out locking elements are found to be quite unstable on the upper outside edge of the flange cap, with the adapter and infusion flask being held together in a straight and aligned configuration. If the operator shakes even slightly, the alignment between adapter and container will be lost. As a result, at least one locking element will be bent far outward and may break off, while generally at least one locking element will return to its initial position and will tilt, thus preventing it from being pushed back into position.

If, for example, a partial amount is to be drawn up into a syringe from an infusion flask, an adapter is not used. Rather, a cannula is pushed onto the syringe, with which the sealing plug of the infusion flask is pierced. This procedure requires a certain routine and a steady hand. In addition, the suctioning-off of the liquid via the cannula is done relatively slowly since the free cross-section of the cannula is very small.

The drawing of medical preparations whose active ingredients are present as lyophilizates is particularly problematical. For example, motor-disrupted MS patients require such preparations for self-medication. Such a medicine is stored in two infusion flasks of size R2. The first infusion flask contains a common salt solution, while the second infusion flask contains the lyophilizate. Up until now, the patient has drawn the common salt solution from the first infusion flask with a disposable syringe with an attached cannula. He has injected the syringe contents into the second infusion flask. Here, attention must be paid to ensuring that the common salt solution does not directly strike the lyophilizate since otherwise clumping is unavoidable. After a shaking process, the solution that consists of common salt solution and lyophilizate is drawn from the second infusion flask and then is finally administered.

An adapter that is known from WO 95/07066 offers an aid for attaching the disposable syringe to the infusion flask. This adapter is attached to the infusion flask as a guide for the disposable syringe. The cannula of the disposable syringe penetrates the closure of the infusion flask with a straight thrust into the adapter. A patient who is unskilled in handling syringes or a motor-disrupted patient will find it hard not to tilt the disposable syringe when inserting it into the adapter. Tilting results in breaking of the cannula. Even if the cannula is inserted into the infusion flask correctly, the above-mentioned danger of clumping always exists with lyophilizates.

This invention is therefore based on the problem of providing an adapter by means of which a liquid can, via a standard syringe, be both drawn from and introduced into a container that is sealed with a plug. The filling process can also be implemented by an unskilled person quickly, reliably, without any risk of injury and with little effort. The danger of contamination is also to be as small as possible. In addition, the drawbacks that are known from the area of the prior art are to be avoided.

The problem is solved by virtue of the fact that, on the one hand, a funnel that is open toward the rear end is arranged on the connecting part of the adapter and, on the other hand, an elastic centering and gripping part is located on the gripping element toward the front end of the adapter. The inner contour of the centering and gripping part corresponds approximately, at least in terms of area, to the outer contour of the flange cap that attaches the plug to the injection container. In addition, the front edge of the centering and gripping part projects over the mandrel, whereby, however, the locking elements remain in the space behind the tip of the mandrel.

The elastic centering and gripping part is, for example, a thin-walled sleeve that extends directly from the base element. The inside diameter of the sleeve is somewhat larger than the outside diameter of the flange cap that attaches the plug to the infusion flask. Inside the sleeve, three or four individual locking elements that project inward are arranged in a plane that is parallel to the base plate. The distance between the base plate and the locking element plane slightly exceeds the height of the flange cap. The sleeve itself is extended several millimeters beyond the locking elements. In this case it is—in order, i.a., to reduce the danger of injury—a few millimeters longer than the mandrel of the adapter. Consequently, the sleeve centers the adapter while being attached to the infusion flask closure. Even if the sleeve almost completely surrounds or covers the flange cap, the tip of the mandrel rests on the plug. As soon as the tip of the mandrel has penetrated the plug, the locking elements rest on the upper edge of the flange cap. As the adapter is pushed further on, the locking elements are pushed outward. In this process, the thin-walled sleeve deforms elastically. In the locking element plane, it achieves a polygon-shaped cross-section as it is pushed on. After the process of pushing it on is complete, the locking elements engage behind the lower edge of the flange cap, whereby the sleeve again assumes its initial cylindrical shape.

Instead of a sleeve with the molded-on locking elements, individual brackets that are arranged on the base element can also be used. The one-piece or multi-piece centering and gripping part can also be designed in such a way that after it is completely attached to the infusion flask, it is at least partially plastically deformed.

In addition, the centering and gripping part can be extended to the point where it partially covers the cylindrical outside surface of the corresponding infusion flask or where the infusion flask completely disappears into it. Here, the entire body of the flask is used as a centering aid.

The infusion flask can also be equipped with an attached and pre-locked adapter, so that when the preparation is prepared and administered, it is not necessary to attach and center the adapter.

The connecting part that is equipped with an inner cone that is arranged on the other side of the gripping element makes it possible to easily attach a syringe that is equipped with an outer cone as a connecting part. The outside cone of the syringe glides along the inner funnel contour into the standardized inner cone that connects to the funnel. The application of a small axial force produces a tight conical connection. The syringe together with the infusion flask via the adapter form a unit that is held together by friction and clamping and that is stable in any position. To fill the syringe or to empty the respective infusion flask, the unit can be brought into the drawing-up position by holding on to just the syringe cylinder. The emptying or filling of the infusion flask is accomplished quickly and with little effort owing to the large hole and nozzle cross-sections in the adapter.

Any nozzle that is integrated in the mandrel has a jet direction that deviates by at least 30° from the center line of the adapter. In this way, the common salt solution is prevented from striking the lyophilizate directly during injection into the second infusion flask. It is generally atomized on the inside wall of the plug and/or flask. Depending on the position of the infusion flask, it flows along there or drops down from there. In this way, the lyophilizate is kept from partially clumping.

To ensure easier or ergonomic handling of the adapter, the funnel is arranged on the gripping element in such a way that the distance between its upper edge and the gripping element is a length that is about ⅔ of the width of the average body-independent index finger of a male adult. To penetrate the sealing plug, for example, the patient holds the adapter between the index finger and the middle finger with the infusion flask positioned below in the area between the funnel and the gripping element, whereby the mandrel points toward the inside of the hand. With the thumb of the same hand, which rests on the bottom of the infusion flask, he moves the infusion flask and the adapter toward one another in a kind of pincer movement. Because of this design, the patient is not forced to connect the adapter to the infusion flask by putting a finger on the sterile funnel.

The edge configuration of the gripping element and/or of the funnel also facilitates simpler handling. At least one of the parts is designed in a flattened manner, for example, in the edge area. Thus, after the packaging that keeps the adapter sterile is removed, it is prevented from rolling away on a slightly inclined plane.

The adapter is produced from a clear, transparent plastic in, for example, an injection-molding process. It preferably consists of one piece. Depending on the application, its mandrel can contain a ventilating duct with or without a particle filter.

In addition, instead of the simple inner cone, an inner cone with a lock, e.g., a Luer-lock inner cone, can be integrated in the base of the funnel.

Other details of the invention will emerge from the embodiment that is described below and depicted diagrammatically.

Figure 1A:
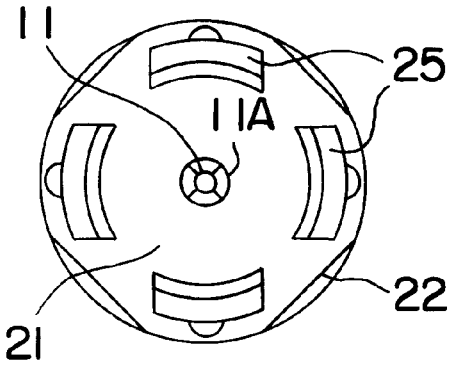
FIG. 1A is a top view of the adaptor.
Figure 1B:
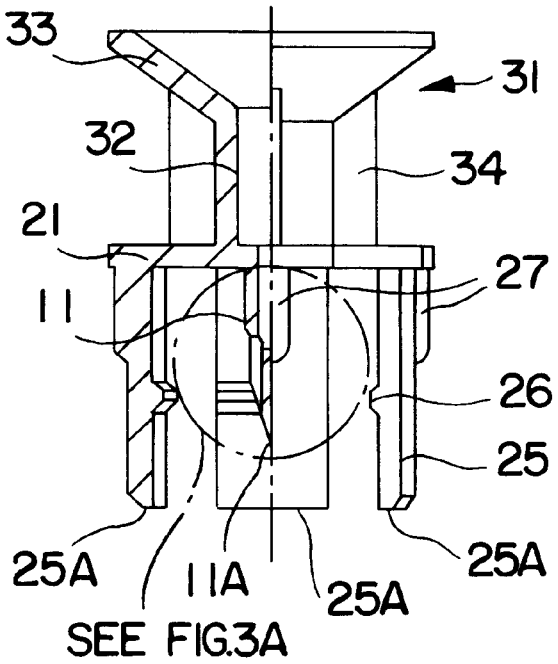
FIG. 1B is a partial side elevation of the adaptor.
Figure 1C:
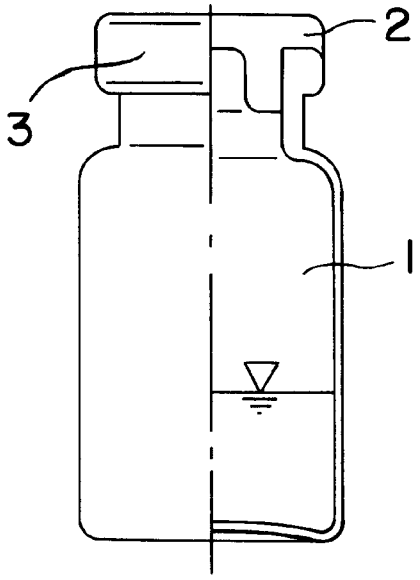
FIG. 1C is a partial side elevation of a container with which the adaptor is used.

In the middle, FIG. 1 shows the adapter in a side view. The adapter is depicted enlarged by about a factor of two and with half a side cut away. It is suitable for drawing a liquid with the aid of a syringe, for example a disposable syringe according to DIN 13098 Part 1 with an outer cone, without an injection cannula, from a sealed injection flask according to DIN ISO 8362 Part 1. Such an injection flask (1), cf. FIG. 1, our drawing, is sealed with a plug (2), which is held in place by an aluminum flange cap (3) on injection flask (1). Injection flask (1) that is depicted has a volume of about 4 ml.

In its central area, the adapter has a gripping plate (21) that is aligned perpendicular to its center line. A mandrel (11) having a tip (11A) is arranged centrically below gripping plate (21). With the mandrel, plug (2) can be penetrated with the tip (11A) when the adapter is attached to injection flask (1). Four brackets (25), which project downward from gripping plate (21), are arranged around mandrel (11), parallel to it. On the one hand, as a centering aid brackets (25) facilitate the attachment of the adapter to the corresponding injection flask (1) and, on the other hand, engage behind it after the lower edge of the flange cap is pushed completely on. A funnel-shaped connecting part (31) is arranged on gripping plate (21), which facilitates the introduction of the outside cone according to DIN 13090 Part 1 of the disposable syringe and produces a tight connection between disposable syringe and adapter.

Figure 3B:
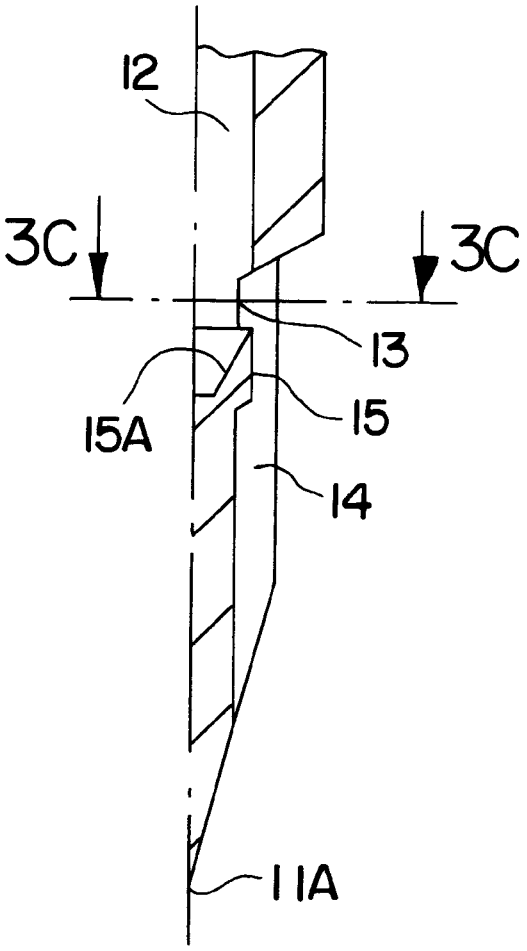
FIG. 3B is an enlarged side elevation of a portion of the adaptor taken along line 3B—3B of FIG. 3A.
Figure 3A:
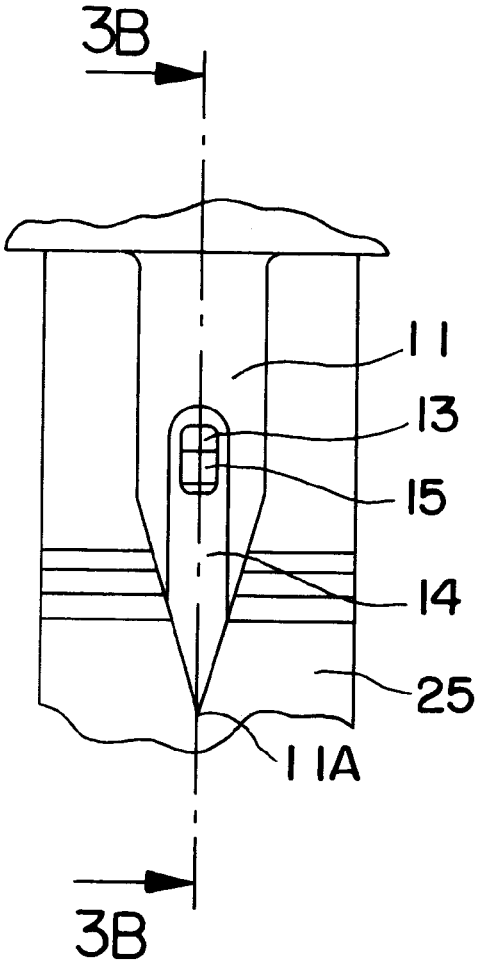
FIG. 3A is an enclosed side view of a portion of the adaptor of FIGS. 1A–1C and 2.
Figure 3C:
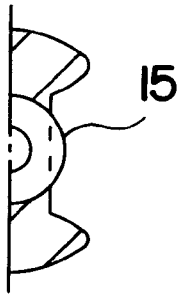
FIG. 3C is an enlarged side elevation of a portion of the adaptor taken along line 3C—3C of FIG. 3B.

Mandrel (11) that is arranged concentrically in connecting part (31) below gripping plate (21) has a basically circular cross-section, which tapers to a tip at least in the front area, cf. FIG. 3. In detail "z" that is depicted here on the lower right, mandrel (11) is shown rotated around the center line of the adapter by 90° relative to the visualization in FIG. 1.

In its upper part, mandrel (11) has a center bore (12) which, approximately in the center of the mandrel, turns into two nozzles (13) that are arranged perpendicular to the center line of the adapter. The diameter of bore (12) corresponds approximately to the diameter of the bore of the outer cone of the standard disposable syringe.

Opposing nozzles (13) have an approximately rectangular opening cross-section. Each nozzle (13) ends in a groove (14) that is oriented in mandrel (11) parallel to the center line of the adapter. Directly below each nozzle (13), there is a lip (15) whose outer contour in the nozzle area corresponds approximately to the contour of bore (12) and in this case rises above the base of the groove. Lip (15) prevents, i.a., nozzles (13) that lie on top from clogging when plug (2) that is made of, for example, rubber is pierced.

To influence the jet direction of nozzles (13), the base of bore (12) can be shaped in various ways. If, for example, spraying at an angle of about 45° to the center line of the adapter is desired, bore (12) is equipped with a plate that has the shape of a gable roof, whereby each side of the roof faces a nozzle. The lower roof edges form the lower edges of the nozzle openings.

Each of four brackets (25) that are arranged around mandrel (11) has a cross-section over its entire length that approximately corresponds to the shape of a circular ring section. The inside diameter of the circular ring section is slightly larger than the outside diameter of flange cap (3) of injection flask (1). The outer contour of the circular ring section is approximately ⅛ the length of the circular periphery. The uncurved side surfaces of brackets (25) form planes that run around the width of the bracket in offset parallel to the center line of the adapter. At approximately half the height of each bracket (25), a detente (26) is arranged on its inner side. Each detente (26) has a trapezoidal cross-section and extends over the entire width of each bracket (25). The side of the nose that is oriented toward gripping plate (21) is inclined by about 30° from the horizontal line. The side of the nose that is oriented in the direction of penetration forms an angle of about 41° with the horizontal line. Detentes (26) rise about 0.7 mm above the inner contour of bracket (25).

On the outer contour, each bracket (25) has a stiffening rib (27) that is aligned parallel to the center line of the adapter and midway to the bracket width in the upper area that is oriented toward gripping plate (21). It has a semicircular cross-section. The rigidity of each bracket (25) can be influenced by appropriately dimensioning the cross-section and length of individual stiffening ribs (27).

Gripping plate (21) that carries mandrel (11) and bracket (25) is a flat, basically circular plate. In the areas between each two brackets (25), in each case the only thing that is lacking for forming a full circle is an arc with an arc height of, for example, 0.9 mm. Flat portions (22) prevent the adapter from rolling on an inclined plane that is slightly tilted from the horizontal line.

Figure 2:
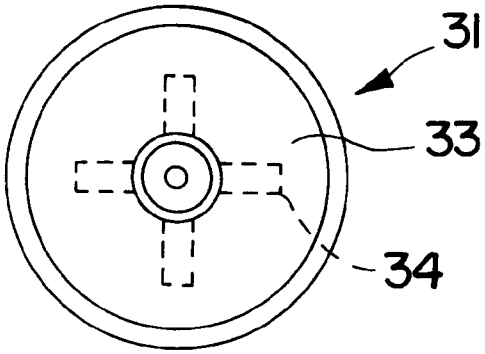
FIG. 2 is a top view of the adaptor of FIGS. 1A–1C.

On base plate (21), connecting part (31) is molded concentrically to mandrel (11). It consists of a funnel (33), an inner cone element (32), and four stiffening ribs (34). Inner cone element (32) is connected directly to base plate (21). It forms the counterpart to the outer cone of the disposable syringe that is to be coupled. By pushing the outer cone of the disposable syringe into inner cone element (32), a relatively rigid connection is created. In this case, the outer cone adheres to inner cone element (32) by friction. Funnel (33) is connected to inner cone element (32). It has an opening angle of, for example, 110°. Its maximum outside diameter corresponds to the base plate diameter. Four stiffening ribs (34) are arranged between funnel (33) and base plate (21) along inner cone element (32). They lie in radial planes relative to the center line of the adapter, cf. FIG. 2. They are indicated there in top view by broken lines. Individual stiffening ribs (34) are arranged midway above brackets (25) in each case. The depth of stiffening ribs (34) is selected in such a way that, for example, the radius of a circumscribed circle that is placed around the outside edges of stiffening ribs (34) lies approximately midway between the outside radius of inner cone element (32) and the maximum radius of funnel (33).

LIST OF REFERENCE NUMERALS

1 Container, infusion flask R2
2 plug
3 flange cap, aluminum flange cap
11 mandrel
12 bore
13 nozzles
14 grooves
15 lips
21 gripping element, gripping plate
22 flat portions
25 centering and gripping part, bracket
26 locking elements, detentes
27 stiffening ribs
31 connecting part
32 inner cone element
33 funnel
34 stiffening ribs

We claim:

1. An adaptor for drawing a liquid from a container (1) or for filling the container wherein the container is sealed using a plug (2) that is attached to the container by a flange cap (3), the adaptor comprising: at least one partially hollow mandrel (11) equipped with at least one nozzle (13) on a front end thereof, a connecting part (31) with a funnel (33) on a rear end, and a flat gripping element (21) in an intermediate area between the front and rear ends thereof; an elastic gripping part (25) arranged on the gripping element (21) toward the front end of the adaptor the elastic gripping part (25) having an inner contour substantially corresponding to the outer contour of the flange cap (3) and having locking elements (26) that engage beneath the flange cap (3) in sections at locations displaced axially from the gripping element (21) by a distance which is at least the height of the flange cap (3), the gripping part (25) having a front edge (25A) that is a centering part projecting over and past a mandrel (11), while the locking elements (26) are located in an area behind the tip (11A) of mandrel (11); and the nozzle (13) being integrated into the mandrel (11), the nozzles (13) each having a jet direction that deviates by at least 30° from the center line of the adaptor.

2. An adaptor according to claim 1, wherein an upper edge of the funnel (33) is spaced from the gripping element (21) by a distance that is equal to ⅔ of the width of the average body-independent index finger of a male adult.

3. An adaptor according to claim 1, wherein the gripping element (21) has outer contours which are noncircular.

4. An adaptor according to claim 1, wherein the adaptor is unitary.

5. An adaptor according to claim 4, wherein the gripping parts (25) comprise a plurality of spring arms which extend directly from the gripping element (21) past of the tip (11A) of the mandrel (11), the locking elements (26) being disposed on the spring arms in spaced relation to front edges (25A) of the spring arms.

6. An adaptor according to claim 4, wherein the mandrel (11) includes axially-extending grooves (14) extending therein from the tip (11A) of the mandrel (11) past the nozzles (13) and wherein the 30° jet direction is achieved by a lip (15) having an inner surface (15A) that slopes outwardly from the axis of the adaptor toward the gripping element (21).

7. An adaptor according to claim 1, wherein the mandrel (11) includes axially-extending grooves (14) extending therein from the tip (11A) of the mandrel (11) past the nozzles (13) and wherein the 30° jet direction is achieved by a lip (15) having an inner surface (15A) that slopes outwardly from the axis of the adaptor toward the gripping element (21).

8. An adaptor according to claim 1, wherein the gripping parts (25) comprise a plurality of spring arms which extend directly from the griping element (21) past of the tip (11A) of the mandrel (11), the locking elements (26) being disposed on the spring arms in spaced relation to front edges (25A) of the spring arms.

9. The adaptor of claim 1, wherein the funnel (33) is supported by axially-extending ribs (34).

* * * * *